US010617217B1

(12) United States Patent
Razon

(10) Patent No.: US 10,617,217 B1
(45) Date of Patent: Apr. 14, 2020

(54) ADJUSTABLE HEIGHT, RESTING POSITION UNIPOD YOGA BODY SUPPORT PROP

(71) Applicant: Eli Razon, Maple Glen, PA (US)

(72) Inventor: Eli Razon, Maple Glen, PA (US)

( * ) Notice: Subject to any disclaimer, the term of this patent is extended or adjusted under 35 U.S.C. 154(b) by 108 days.

(21) Appl. No.: 16/010,474

(22) Filed: Jun. 17, 2018

Related U.S. Application Data

(60) Provisional application No. 62/521,468, filed on Jun. 18, 2017.

(51) Int. Cl.

| | |
|---|---|
| ***A47C 9/00*** | (2006.01) |
| ***A47C 3/34*** | (2006.01) |
| ***A47C 3/40*** | (2006.01) |
| ***A63B 21/00*** | (2006.01) |

(52) U.S. Cl.
CPC ..... *A47C 9/002* (2013.01); *A47C 3/34* (2013.01); *A47C 3/40* (2013.01); *A63B 21/4027* (2015.10)

(58) Field of Classification Search
CPC .. A47C 9/002; A47C 3/40; A47C 3/34; A47C 7/004; A47C 9/025; A47C 9/02; A47C 3/20; A47C 9/00; A47C 3/00; A47C 3/30; A47C 7/00; A47C 15/004; A47C 3/22; A47C 7/02; A47C 7/402; A63B 21/0004; A63B 21/4027–4031; A63B 2208/0228–0233
USPC ..... D6/330
See application file for complete search history.

(56) References Cited

U.S. PATENT DOCUMENTS

| | | | | | |
|---|---|---|---|---|---|
| 690,122 | A * | 12/1901 | Slagle | A45B 5/00 | 248/155 |
| 2,099,345 | A * | 11/1937 | Olszanowski | A47C 9/10 | 297/4 |
| 4,676,547 | A * | 6/1987 | Spillman | A47C 9/10 | 297/4 |
| 4,700,914 | A * | 10/1987 | Cheetham | A47C 9/10 | 108/150 |
| 5,178,595 | A * | 1/1993 | MacGregor | A61H 3/02 | 135/68 |
| 5,411,313 | A * | 5/1995 | Counihan | A45B 5/00 | 135/66 |
| 5,927,797 | A * | 7/1999 | Ferguson | A47C 7/029 | 297/4 |
| 6,033,016 | A * | 3/2000 | Haywood | A47C 9/025 | 297/195.11 |
| 6,062,638 | A * | 5/2000 | Ferguson | A47C 9/025 | 297/4 |
| 7,594,696 | B2 * | 9/2009 | Girard | A47C 9/025 | 297/130 |
| 9,715,869 | B1 * | 7/2017 | Sorenson | F16M 11/28 | |
| 10,172,468 | B2 * | 1/2019 | Houghson | A47C 16/00 | |
| 2005/0225141 | A1 * | 10/2005 | Marchand | A47C 9/025 | 297/337 |

(Continued)

*Primary Examiner* — Andrew S Lo

(57) ABSTRACT

A height adjustable, resting position unipod yoga body support prop is provided with an adjustable length multi-section leg attached at opposing ends to an upper platform for contact with a body part of a yoga user and an arcuate shaped base surface for a degree of forward and backward positioning adjustment of the yoga user when positioned on the upper platform. The unipod leg is adjustable in height to assist in assuming various yoga positions with the yoga prop. The upper platform, leg and base of the yoga prop can be disassembled for transportation and storage.

18 Claims, 13 Drawing Sheets

(56) References Cited

U.S. PATENT DOCUMENTS

| | | | | |
|---|---|---|---|---|
| 2006/0103207 | A1* | 5/2006 | Marchand | A47C 9/025<br>297/313 |
| 2008/0036259 | A1* | 2/2008 | Huang | A47C 9/005<br>297/313 |
| 2010/0052397 | A1* | 3/2010 | Mishly | A47C 3/34<br>297/451.4 |
| 2011/0113990 | A1* | 5/2011 | Wald | A47C 16/02<br>108/42 |
| 2011/0198897 | A1* | 8/2011 | Hosler | A47C 9/025<br>297/195.11 |
| 2012/0184410 | A1* | 7/2012 | Foster | A63B 21/023<br>482/8 |
| 2012/0220431 | A1* | 8/2012 | Signorile | A63B 26/003<br>482/92 |
| 2016/0038780 | A1* | 2/2016 | Hugou | A47C 3/029<br>482/8 |
| 2018/0199719 | A1* | 7/2018 | Keen | A47C 7/029 |
| 2018/0236293 | A1* | 8/2018 | Chiu | A47C 9/002 |
| 2018/0271289 | A1* | 9/2018 | Gregory | A47C 3/26 |
| 2018/0353791 | A1* | 12/2018 | Hugou | A63B 21/0023 |
| 2019/0029474 | A1* | 1/2019 | Preece | A47K 3/282 |

* cited by examiner

ADJUSTABLE HEIGHT, RESTING POSITION UNIPOD YOGA BODY SUPPORT PROP

CROSS REFERENCE TO RELATED APPLICATIONS

This application claims the benefit of U.S. Provisional Application No. 62/521,468 filed Jun. 18, 2017, which is hereby incorporated by reference in its entirety.

FIELD OF THE INVENTION

The present invention relates to a yoga body support prop that can be used to assist in maintaining various yoga positions and in particular to an adjustable height, resting position unipod yoga body support prop.

BACKGROUND OF THE INVENTION

The quarter lotus and similar yoga positions can be assumed by sitting on a meditation seat with legs loosely crossed and both feet resting below the opposing thigh or knee.

Seiza and similar yoga positions can be assumed by kneeling with a yoga block between the legs to rest the buttocks on.

A resting yoga squatting position can be supported by resting the buttocks on a bench.

One objective of the present invention is to provide an adjustable height, compact, lightweight and easily transportable resting position unipod seat that can be used to comfortably assist in assuming various yoga positions including lotus, seiza and squat position.

BRIEF SUMMARY OF THE INVENTION

In one aspect the present invention is a portable adjustable height, resting position unipod yoga body support prop comprising an upper platform, an adjustable length unipod leg and a base In some embodiments of the present invention the upper platform has a cushioning surface for contact with a body part of a yoga user. The cushioning surface is in contact with an upper platform body part support surface of an upper platform support structure that comprises an upper platform structural support system and an upper platform unipod leg fastener engagement element.

In some embodiments of the invention the adjustable length unipod leg has a leg upper section and a leg lower section. The leg upper section has an upper platform attachment fastener at a first upper section end of the leg upper section and a leg lower section attachment fastener at second upper section end of the leg upper section where the first upper section end opposes the second upper section end. The leg lower section has a plurality of fastener engagement elements aligned along the length of the leg lower section for the yoga user's selective engagement of the upper platform attachment fastener in one of the plurality of fastener engagement elements and the leg lower section has a leg lower section base attachment end.

In some embodiments of the invention the base has an arcuate contact surface for base contact with a unipod prop support surface. The arcuate contact surface is in contact with a base unipod leg support surface on a base support structure that has a base structural support system and a leg lower section joiner element for receiving the leg lower section base attachment end.

The arcuate contact surface in contact with the base support structure provides forward and backward position adjustment from a unipod prop vertical position of the yoga user when the yoga prop of the present invention is assembled by the upper platform attachment fastener engaging the upper platform unipod leg fastener engagement element; the leg lower section attachment fastener engaging one of the plurality of fastener engagement elements; and optionally the leg lower section base attachment end engaging the leg lower section joiner element in embodiments of the present invention where the leg lower section base attachment end is not permanently attached to the leg lower section base attachment end.

In some embodiments of the invention the upper platform, one or more sections of the adjustable length unipod leg and base can be conveniently assembled and disassembled for transportation and storage.

The above and other aspects of the invention are set forth in this specification and the appended claims.

BRIEF DESCRIPTION OF THE DRAWINGS

FIG. 3(*b*) is a right side detail view of the base and leg lower section of the unipod yoga support prop shown in FIG. 3(*a*).

FIG. 5(*b*) is a left side detail view of the base and leg lower section of the unipod yoga support prop shown in FIG. 5(*a*).

DETAILED DESCRIPTION OF THE INVENTION

There is shown in FIG. 1 through FIG. 8 one example of a portable, adjustable height, resting position unipod yoga body support prop 10 of the present invention formed from an upper platform 20, an adjustable length unipod leg 30 and a base 40.

Figure 1:
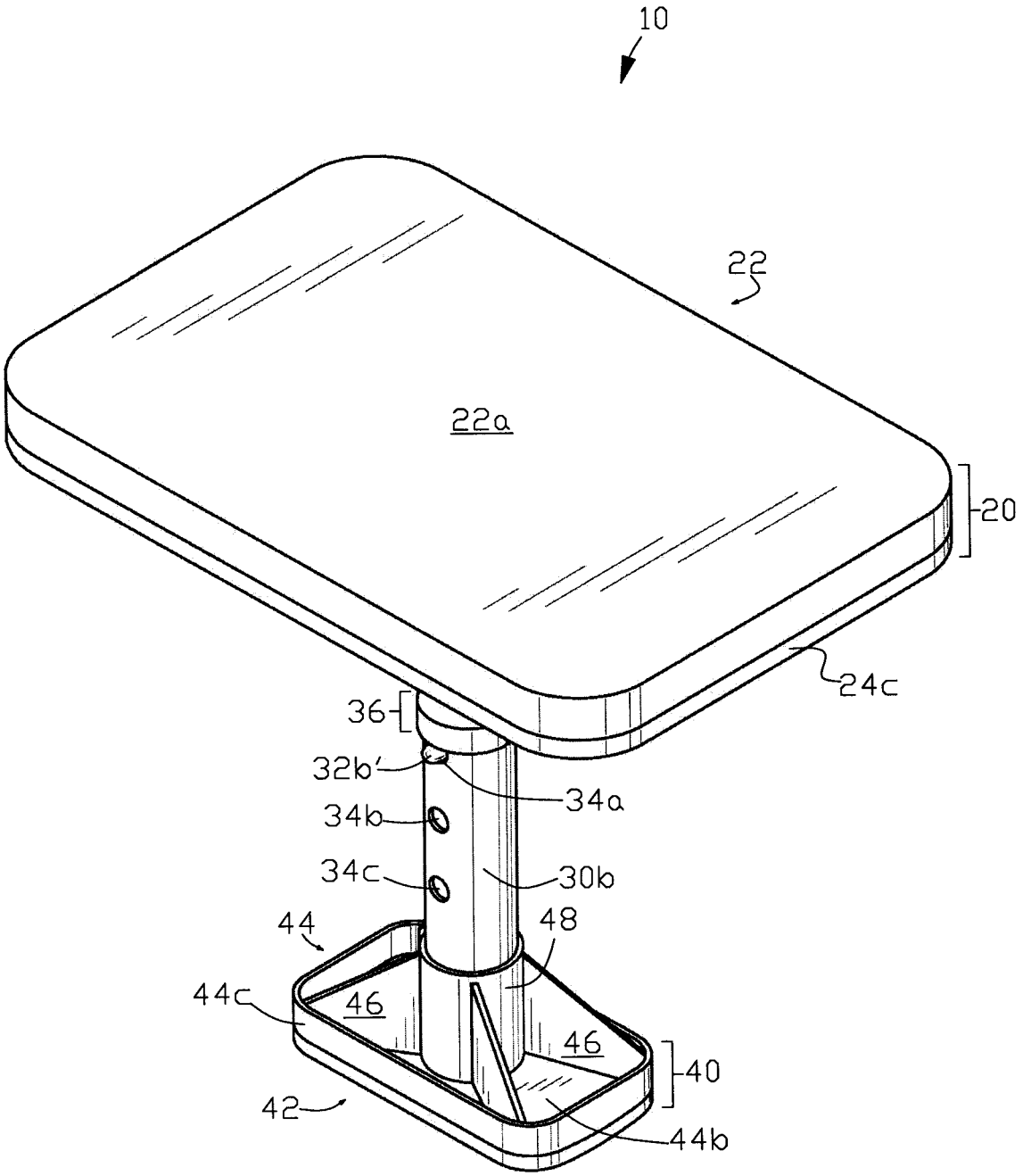
FIG. 1 is a perspective view of one example of an adjustable height, resting position unipod yoga support prop of the present invention.
Figure 2:
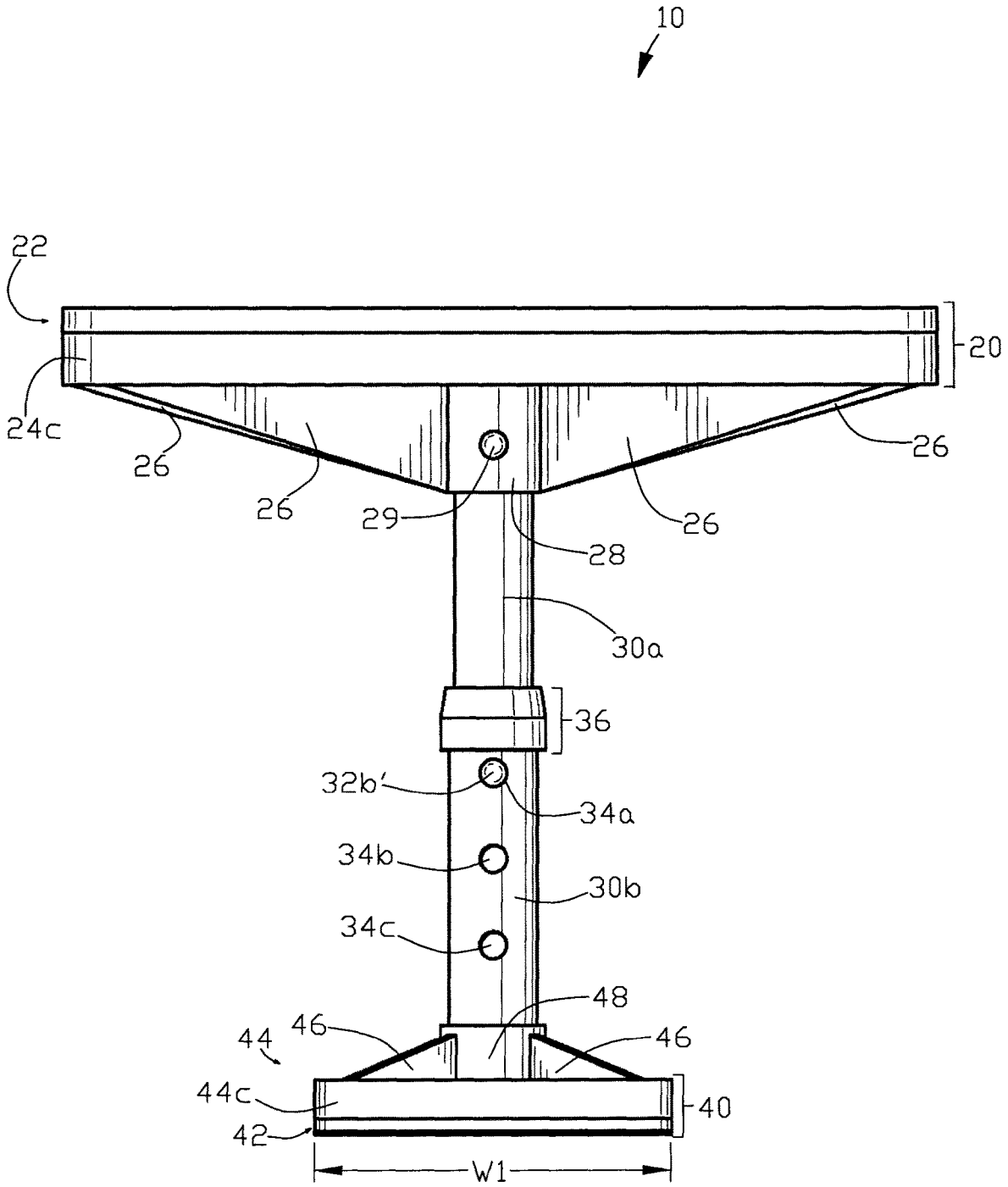
FIG. 2 is a front elevation view of the unipod yoga support prop shown in FIG. 1.
Figure 3A:
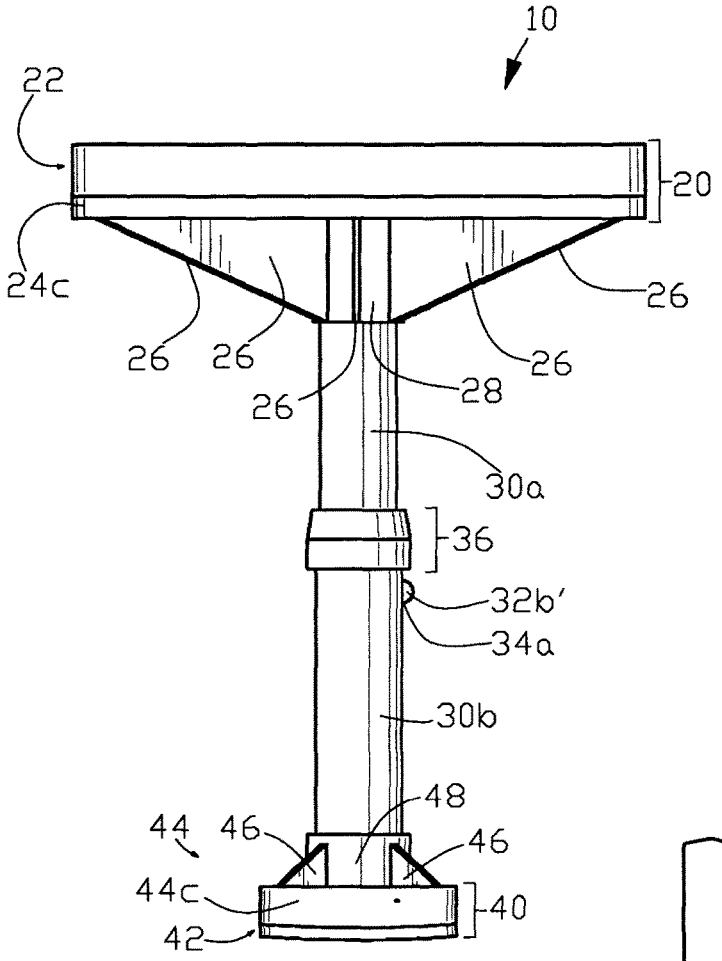
FIG. 3(*a*) is a right side elevation view of the unipod yoga support prop shown in FIG. 1.
Figure 3B:
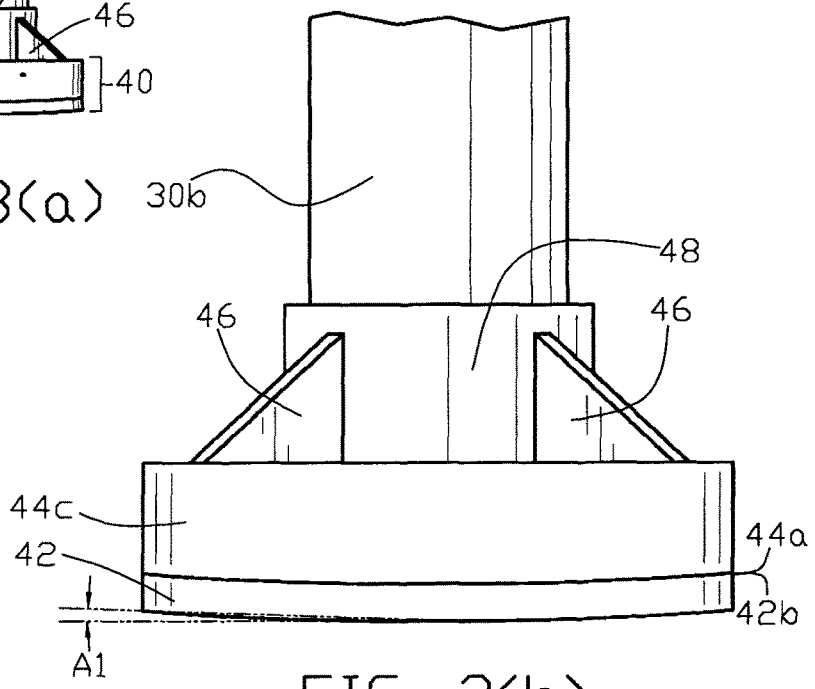
Figure 4:
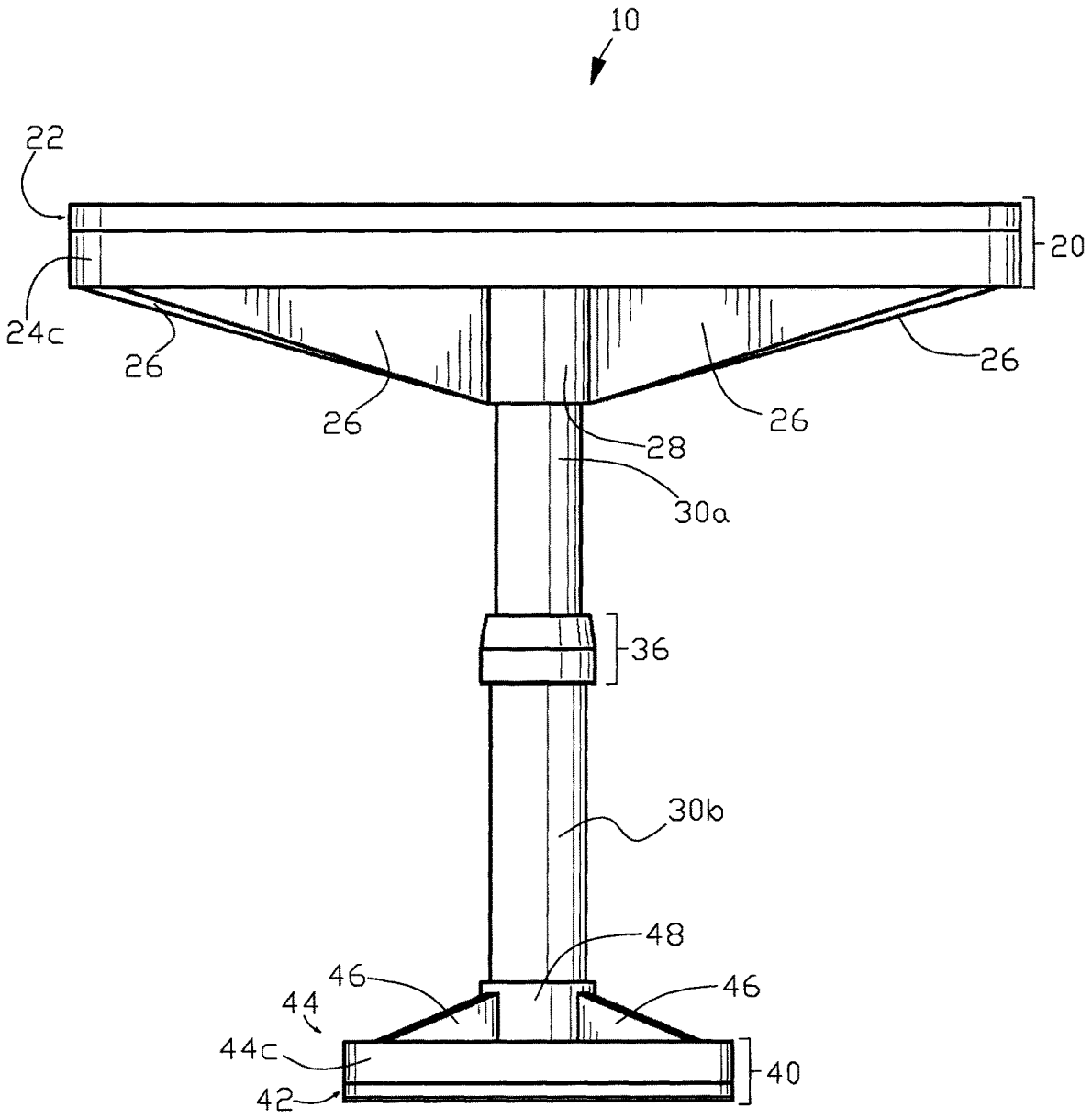
FIG. 4 is a rear elevation view of the unipod yoga support prop shown in FIG. 1.
Figure 5A:
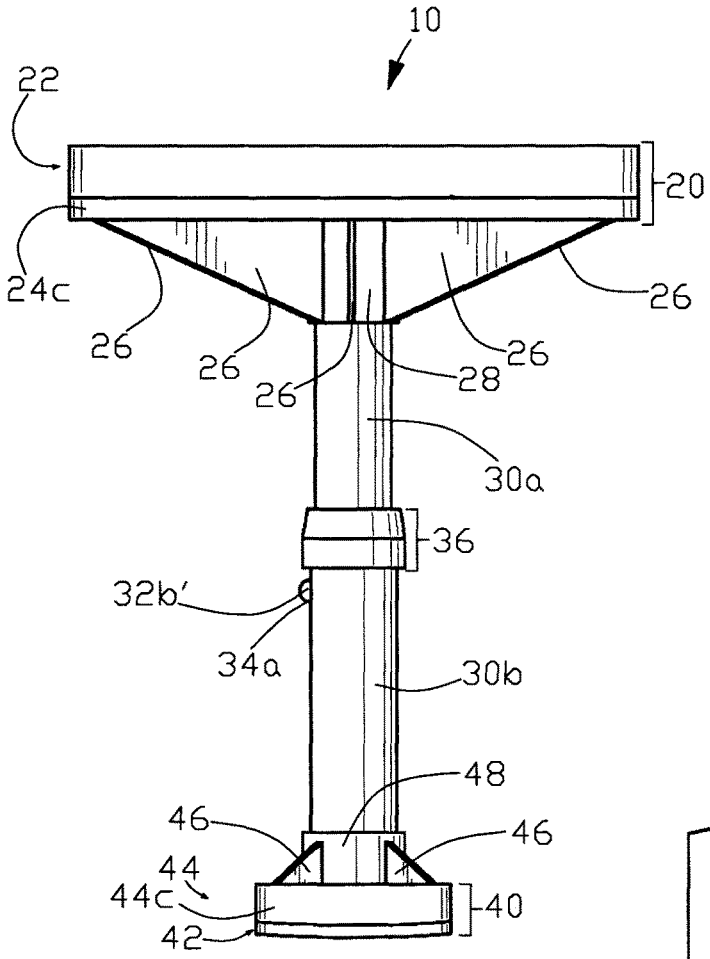
FIG. 5(*a*) is a left side elevation view of the unipod yoga support prop shown in FIG. 1.
Figure 5B:
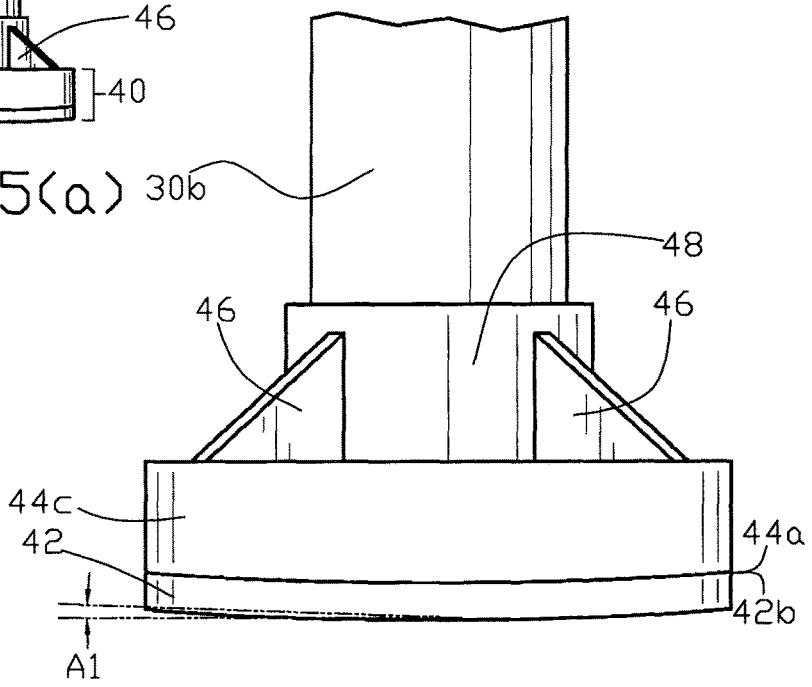
Figure 6:
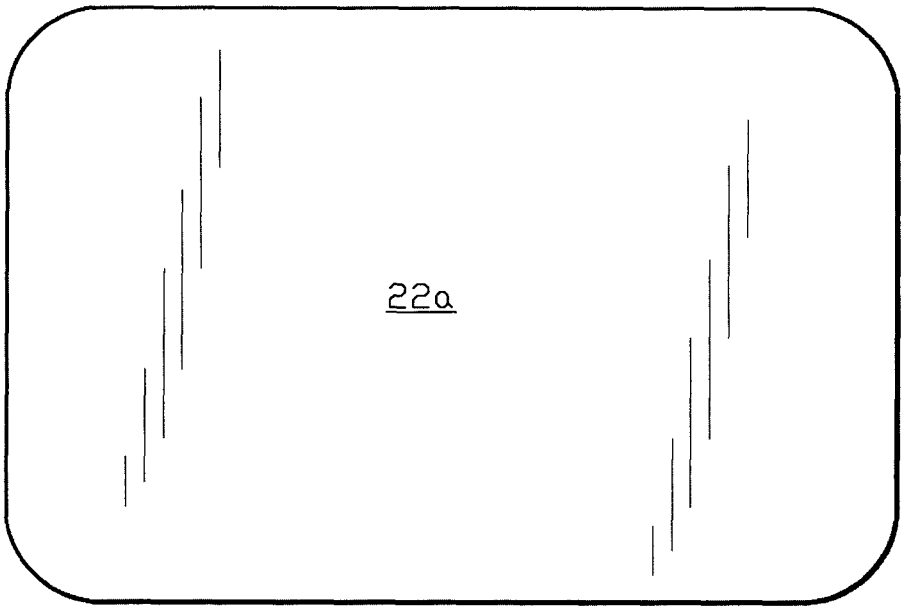
FIG. 6 is a top plan view of the unipod yoga support prop shown in FIG. 1.
Figure 7:
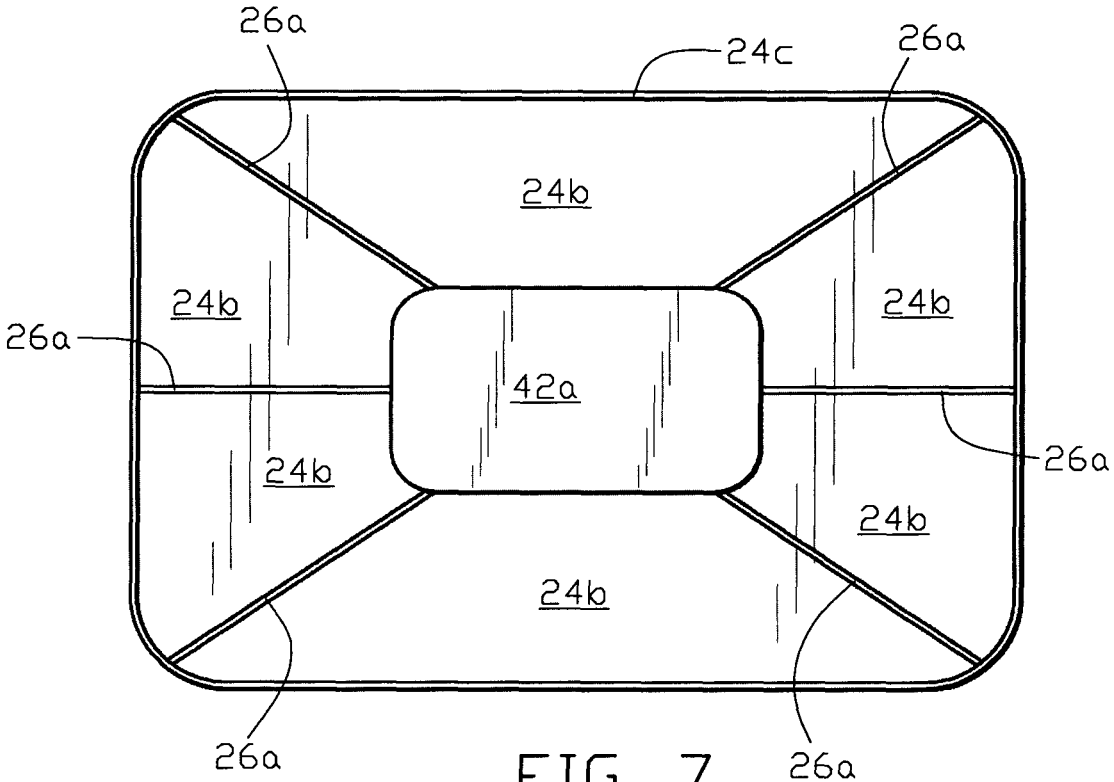
FIG. 7 is a bottom plan view of the unipod yoga support prop shown in FIG. 1
Figure 8:
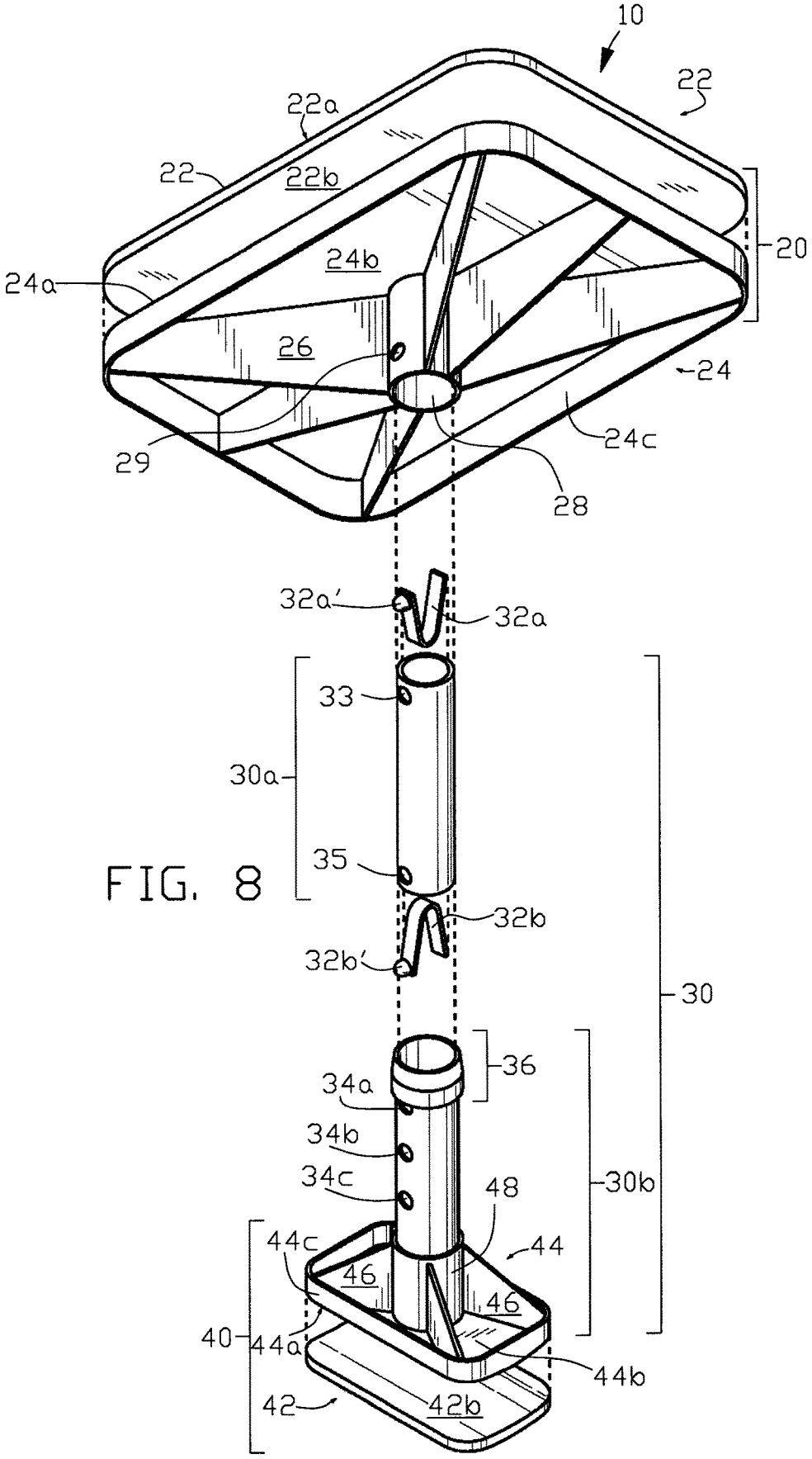
FIG. 8 is an exploded view of the unipod yoga support prop at shown in FIG. 1.

In this embodiment of the invention upper platform 20 comprises a cushioning layer 22 upon which upper surface 22*a* a yoga user's body part makes contact with. The lower surface 22*b* of the cushioning layer makes contact with upper platform body part support surface 24*a* of an upper platform support structure 24 having an upper platform structural support system and an upper platform unipod leg fastener engagement element as best seen in FIG. 8.

In this embodiment of the invention the upper platform leg fastener engagement element 28 is centrally attached to an inner surface 24*b* of the upper platform support structure that opposes the upper platform body part support surface 24*a*.

In one embodiment of the invention the upper platform structural support system comprises an upper platform skirt 24*c* surrounding an upper platform perimeter of the upper platform body part support surface 24*a* and a plurality of structural support upper platform support members 26 radiating out from the upper platform unipod leg fastener engagement element 28 to an interior surface of the upper platform skirt 24*c*. Each of the plurality of structural support upper platform support members 26 is attached to the inner surface 24*b* of the upper platform support structure as shown in the figures.

In this embodiment of the invention adjustable length unipod leg 30 comprises a leg upper section 30*a* and a leg lower section 30*b*. The leg upper section has an upper platform attachment fastener 32*a* at a first end of the leg upper section and a leg lower section attachment fastener 32*b* at a second end of the leg upper section. The leg lower section 30*b* has a plurality of fastener engagement elements 34*a*, 34*b* and 34*c* arranged along the length of the leg lower section for selective engagement of the leg lower section attachment fastener 32*b* in one of the plurality of fastener engagement elements.

In some embodiments of the invention the leg upper section and leg lower section are tubular in shape with complementary circular cross sectional shapes of different interior and exterior diameters that allow one leg section to telescope into and out of the other leg section. In the embodiment of the invention shown in the drawings the tubular leg upper and lower sections have complementary shapes that allow the leg upper section to telescope into or out of the leg lower section. In other embodiments of the invention the leg upper section and leg lower section may be of other cross sectional geometric shapes such as rectangular, triangular or hexagonal as long as one leg section can telescope into and out of the other leg section.

In this embodiment of the invention base 40 comprises an arcuate friction layer 42. The upper surface 42*b* of the arcuate friction layer makes contact with base unipod leg arcuate support surface 44*a* of a base support structure 44 having a base support system and a leg lower section joiner element. The arcuate friction layer is suitably attached to the base unipod arcuate support surface 44*a* and allows forward and backward angular motion of the base 40, adjustable length unipod leg 30 and upper platform 20 through angle A1 shown in FIG. 3(*b*) and FIG. 5(*b*) for position adjustment when a yoga user is positioned on the upper platform.

In this embodiment of the invention the lower leg section joiner element 48 is centrally attached to a base inner surface 44*b* of the base support structure that opposes the base unipod leg arcuate support surface 44*a*.

In one embodiment of the invention the base structural support system comprises a base skirt 44*c* surrounding a base perimeter of the base unipod leg arcuate support surface 44*a* and a plurality of structural support base support members 46 radiating out from the leg lower section joiner element 48 to an interior surface of the base skirt 44*c*. Each of the plurality of structural support base support member 46 is attached to the base inner surface 44*b* of the base support structure 44.

In some embodiments of the invention the upper platform attachment fastener is a spring-loaded upper platform snap button 32*a* disposed with the first upper section end of the leg upper section with an upper platform button 32*a*' protruding through a first upper section end hole 33 and the upper platform unipod leg fastener engagement element is an upper platform tubular section 28 having a cross sectional geometric shape complementary for insertion of the first upper section end of the upper leg section into the upper platform tubular section 28 with locking engagement of the upper platform button 32*a*' into an upper platform tubular section hole 29 in the upper tubular section.

Figure 14:
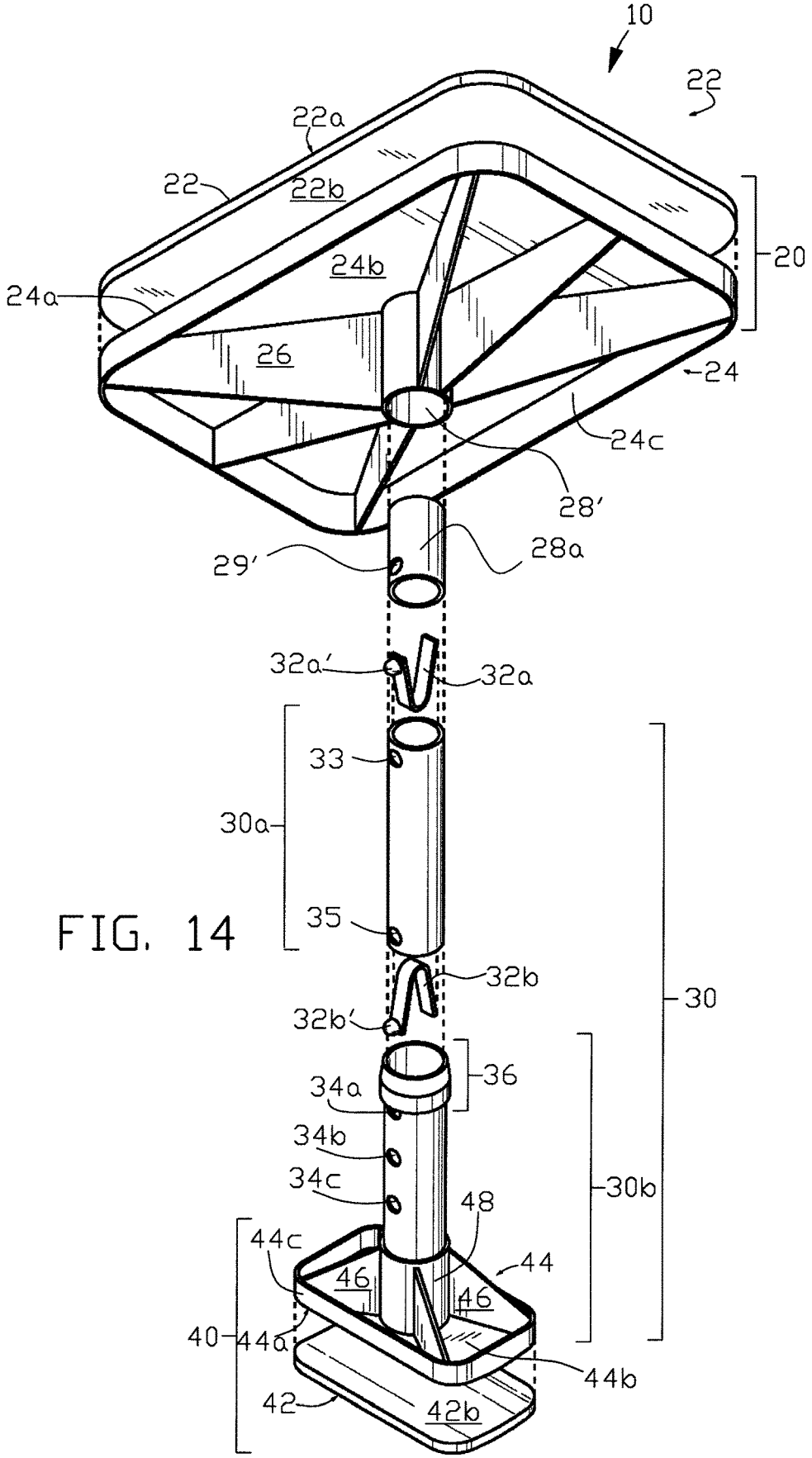
FIG. 14 is an exploded view of another embodiment of a unipod yoga support prop of the present invention.

In another embodiment of the invention an intermediate upper platform attachment fitting 28*a* is provided for seating in an upper platform tubular section 28' without a hole with the upper platform tubular section hole 29' provided in the intermediate upper platform attachment fitting 28*a* as shown in FIG. 14.

In some embodiments of the invention the leg lower section attachment fastener comprises a spring-loaded leg lower section snap button 32*b* disposed within the second upper section end of the leg upper section with a leg lower section button 32*b*' protruding through a second upper section end hole 35 and each of the plurality of fastener engagement elements comprise a lower leg section unipod height adjustment hole 34*a*, 34*b* or 34*c* for locking engagement of the leg lower section button 32*b*' with the second upper section leg end telescoping into the leg lower section end opposing the leg lower section base attachment end.

In some embodiments of the invention the leg lower section joiner element comprises a base tubular section 48 having a cross sectional geometric shape complementary for insertion of the leg lower section base attachment end into the base tubular section 48. The leg lower section base attachment end may alternatively be fixed or removably fitted into the base tubular section.

In some embodiments of the invention the upper platform leg fastener engagement element and the upper platform structural support system may be formed from an injection moulded thermoplastic material with exposed structural support members to minimize weight of the upper platform.

In some embodiments of the invention the leg lower section joiner element and the base structural support system may be formed from an injection moulded thermoplastic material with exposed structural support members to minimize weight of the base.

In some embodiments of the invention cushioning layer 22 may be formed from a thin layer of rubber composition or other compressible cushioning material. Cushioning layer 22 may be alternatively removably fitted to upper platform support structure or fixed to the upper platform support structure with a suitable adhesion material. In some embodiments of the invention the cushioning layer may be sprayed or otherwise applied to the upper platform body part support surface 24*a*.

In some embodiments of the invention the leg upper section and the leg lower section may be formed from a lightweight material such as aluminum.

While six structural support upper platform support members and four structural support base support members are shown in the drawings different numbers of structural support members may be used in other embodiments of the inventions.

In some embodiments of the invention the first upper section end hole 33 and the second upper section end hole 35 are spaced the same distance from their respective first and second ends of the leg upper section and aligned so that either end may be fitted into upper platform leg fastener engagement element 28 or leg lower section 30*b*.

In some embodiments of the invention a keyed joint can be provided between leg upper section 30*a* and upper platform leg fastener engagement element 28 or leg lower section 30*b* to assist in radial alignment of tubular leg sections to seat the leg upper section in the upper platform leg fastener engagement element or the leg lower section.

In some embodiments of the invention funnel guide ring 36 can be fitted to the upper end of leg lower section 30*b* to assist in inserting the second upper section end of the leg upper section into the leg lower section. In some embodiments of the invention the cross sectional opening end of the leg lower section can be flared outwardly to assist in the insertion.

In some embodiments of the invention leg lower section 30*b* is permanently seated into the leg lower section joiner element 48 to form a part of base 40.

Figure 13:
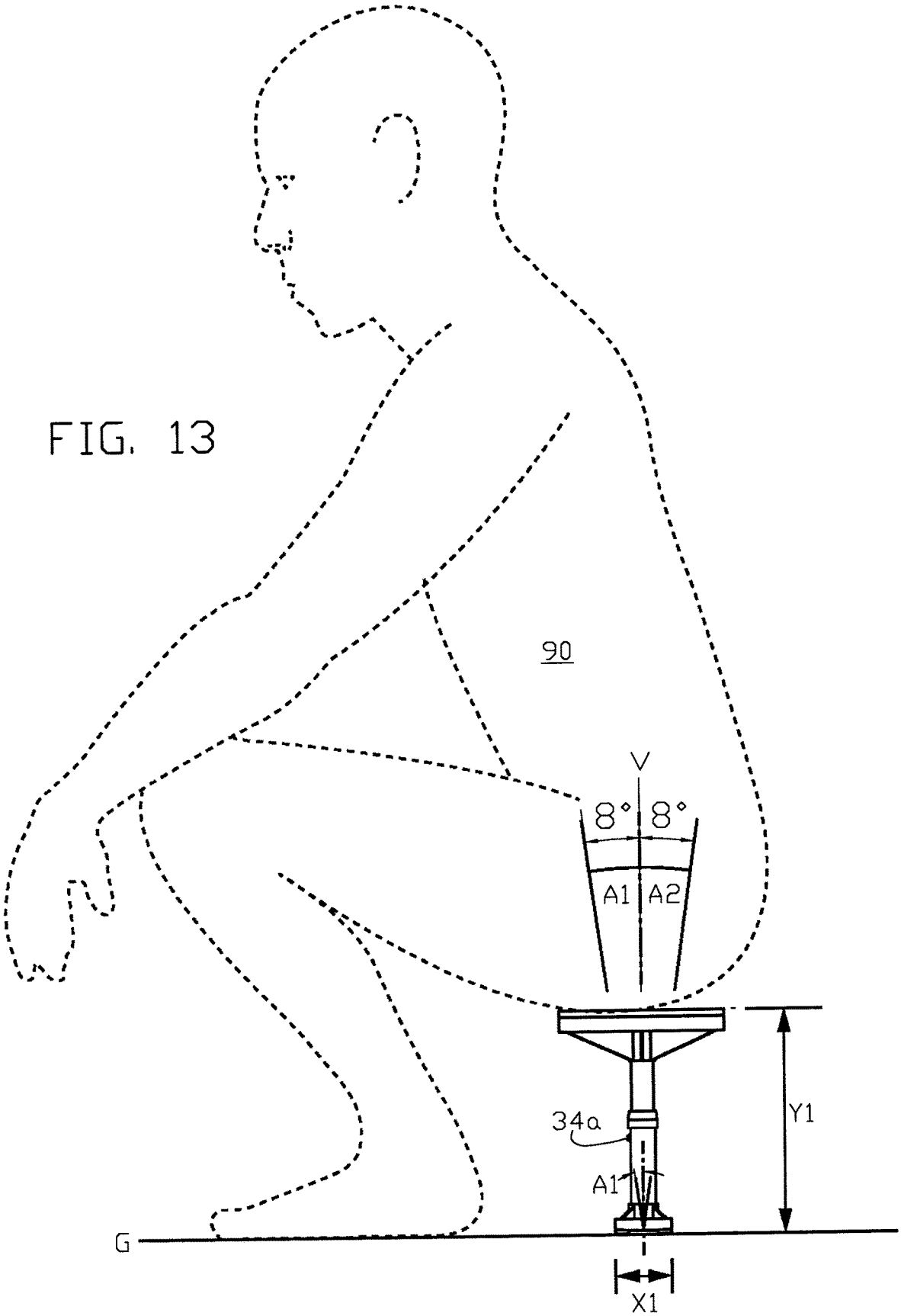
FIG. 13 is one example of the unipod yoga support seat shown in FIG. 1 in use to support a body part of a yoga user in assuming a squat position with illustration of one preferred arcuate contact surface for base contact with a unipod prop support surface with forward and backward adjustment in the squat position.

In one preferred embodiment on the invention upper platform 20 and base 40 are rectangular in cross sectional shape with curved corners with the overall rectangular dimensions of upper platform 20 being approximately three times as large as the rectangular linear dimensions of the base, for example, with the upper platform 20 being 9 inches wide by 6 inches deep and the base 40 being 4 inches wide by 2.5 inches deep (X1 in FIG. 13). The width of the base W1 (in FIG. 2) is held sufficiently small for example, between 4 and 6 inches, so as not to require any spreading apart of a yoga user's lower legs when in the seiza or similar yoga positions while the arcuate friction layer and base unipod leg arcuate support surface allows a yoga user to assume a position where the plane of cushioning layer 22 and upper surface 22*a* of upper platform 22 is in line with the yoga user's upper leg so that the yoga position can be comfortably maintained relative to the yoga user's body part on the cushioning layer.

Figure 9:
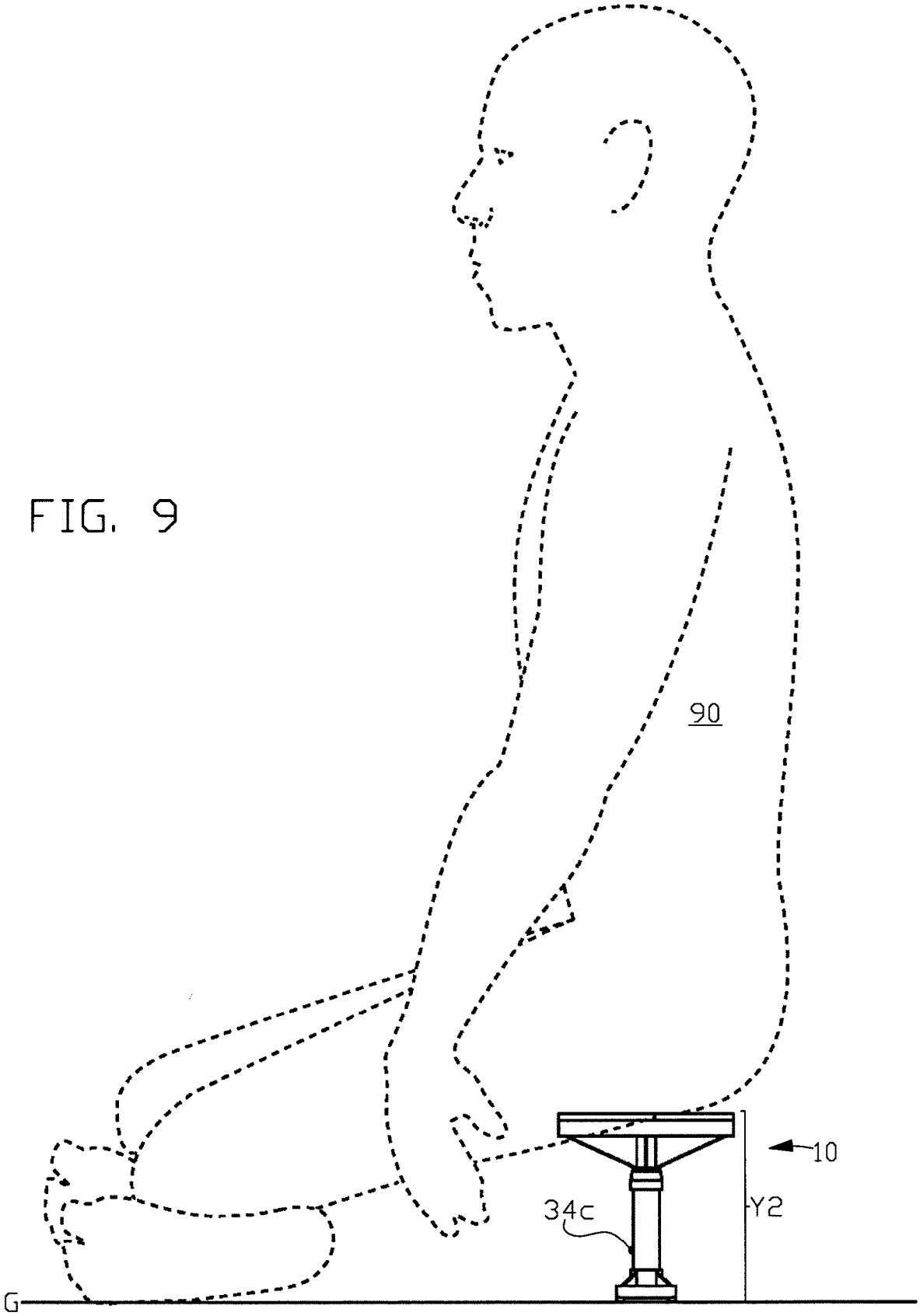
FIG. 9 is one example of the unipod yoga support prop shown in FIG. 1 in use to support a body part of a yoga user in assuming a lotus position.
Figure 10:
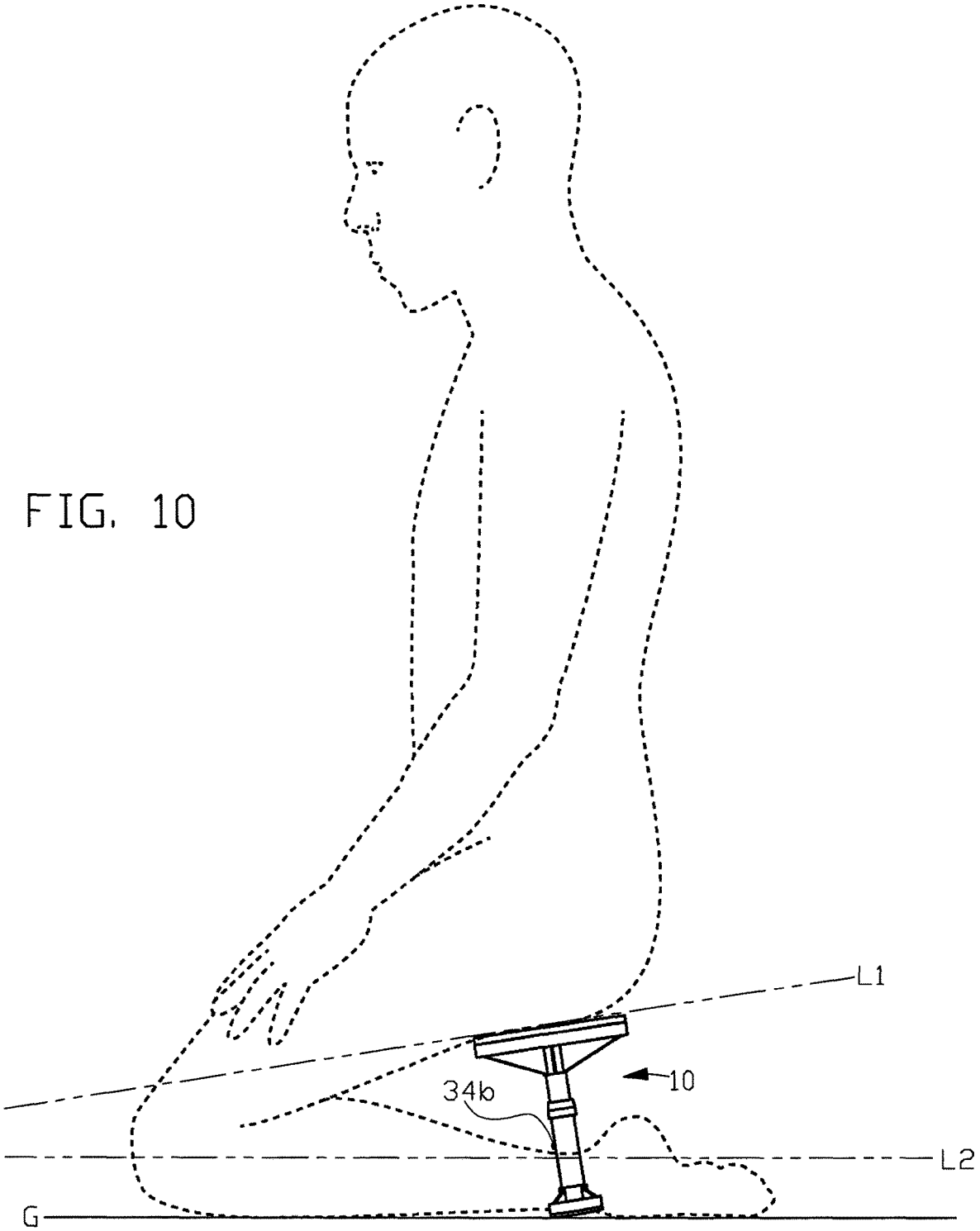
FIG. 10 is one example of the unipod yoga support prop shown in FIG. 1 in use to support a body part of a yoga user in assuming a seiza position.
Figure 11:
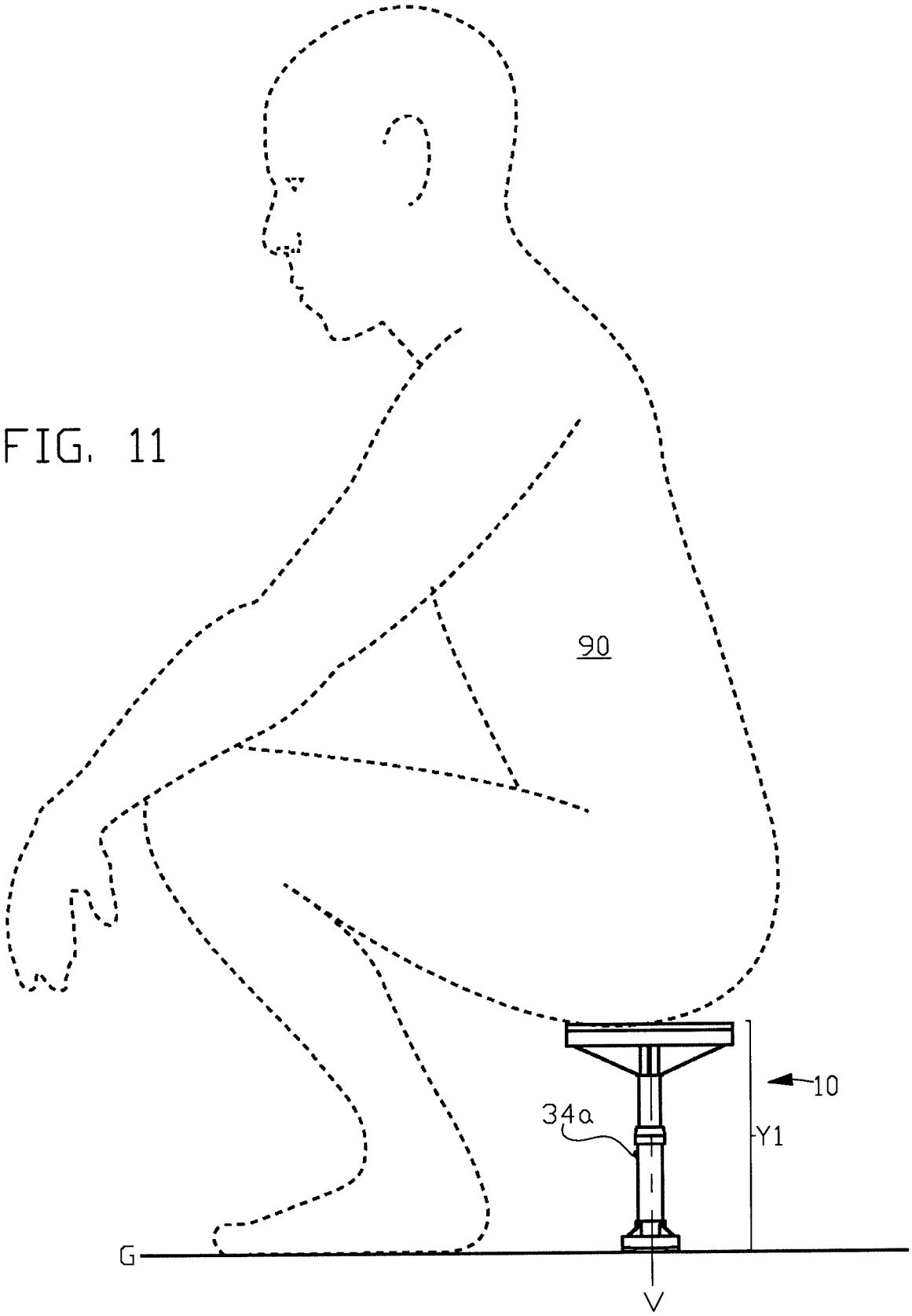
FIG. 11 is one example of the unipod yoga support prop shown in FIG. 1 in use to support a body part of a yoga user in assuming a squat position.

In some embodiments of the invention leg lower section button 32*b*' is locked into leg section unipod height adjustment hole 34*c* to assist in assuming a lotus or similar yoga position as shown in FIG. 9 with a typical overall height Y2 of 6 inches. In some embodiments of the invention leg lower section button 32*b*' is locked into leg section unipod height adjustment hole 34*b* to assist in assuming a seiza or similar yoga position as shown in FIG. 10. In some embodiments of the invention leg lower section button 32*b*' is locked into leg section unipod height adjustment hole 34*a* to assist in assuming a squat or similar yoga position as shown in FIG. 11. In one embodiment of the invention a suitable overall height (Y1) of an adjustable height, resting position unipod yoga body support prop of the present invention with the leg lower section button 32*b*' locked into section unipod adjustment hole 34*a* in FIG. 13 is 7 inches with an overall range of height adjustment being typically between 6 and 8 inches.

Figure 12:
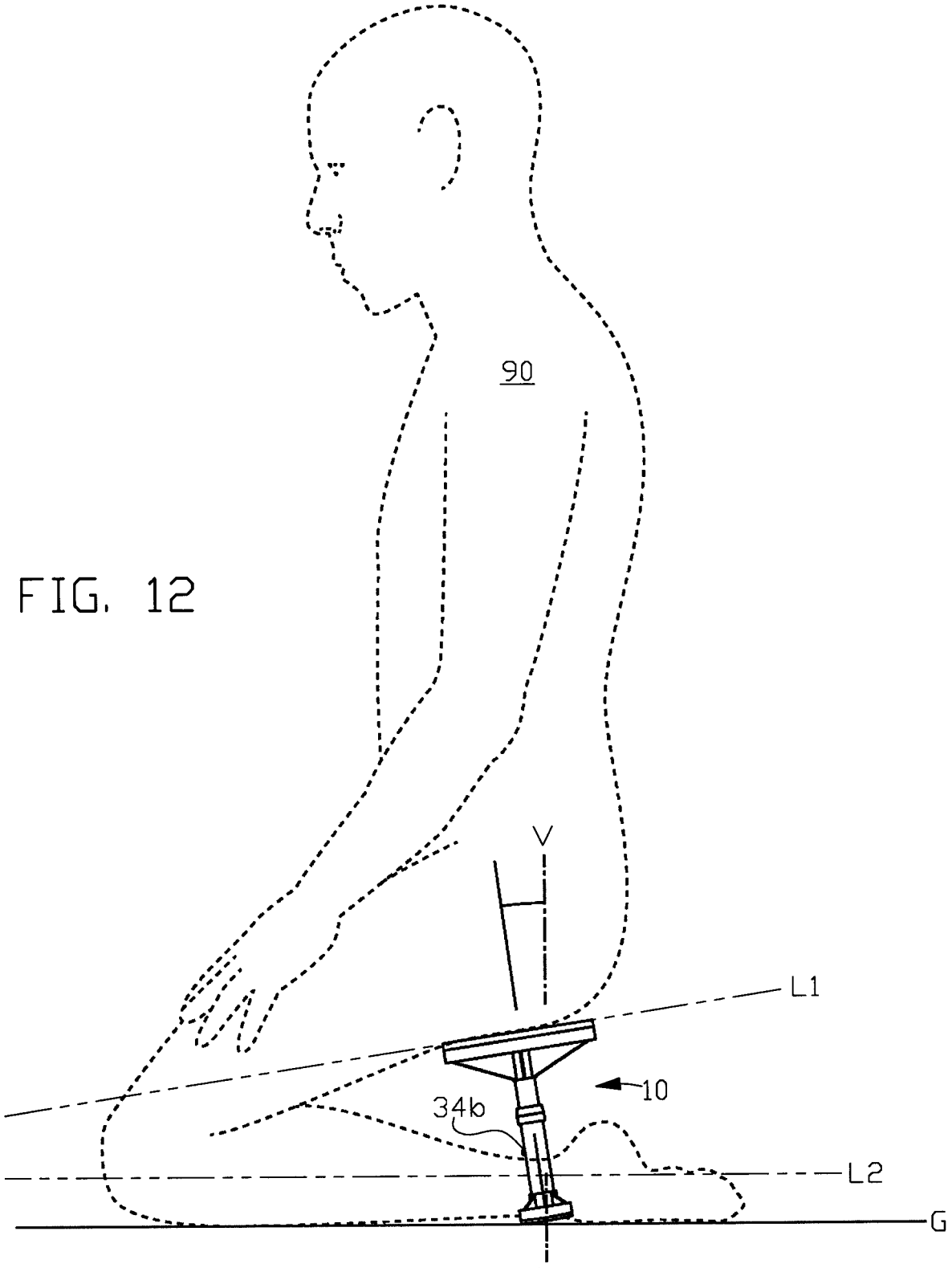
FIG. 12 is one example of the unipod yoga support seat shown in FIG. 1 in use to support a body part of a yoga user in assuming a seiza position with illustration of one preferred arcuate contact surface for base contact with a unipod prop support surface in the seiza position.

In the present invention as shown in FIG. 12 base 40 has the arcuate friction layer 42 of base 40 in contact with ground level G so that a forward and backward angle of adjustment is provided when a yoga user is seated on the upper platform. As shown in FIG. 13 in one embodiment of the present invention the forward or backward angular rotation is 8 degrees from vertical V when the yoga user is in a squat or similar yoga position.

Reference throughout this specification to "one example or embodiment," "an example or embodiment," "one or more examples or embodiments," or "different example or embodiments," for example, means that a particular feature may be included in the practice of the invention. In the description various features are sometimes grouped together in a single example, embodiment, figure, or description thereof for the purpose of streamlining the disclosure and aiding in the understanding of various inventive aspects.

The present invention has been described in terms of preferred examples and embodiments. Equivalents, alternatives and modifications, aside from those expressly stated, are possible and within the scope of the invention.

The invention claimed is:

1. A portable adjustable height, resting position unipod yoga body support prop comprising:

an upper platform having a cushioning layer for contact with a body part of a yoga user, the cushioning layer in contact with an upper platform body part support surface of an upper platform support structure having an upper platform structural support system and an upper platform unipod leg fastener engagement element;

an adjustable length unipod leg having a leg upper section and a leg lower section, the leg upper section having an upper platform attachment fastener at a first upper section end of the leg upper section and a leg lower section attachment fastener at a second upper section end of the leg upper section, the first upper section end opposing the second upper section end, the leg lower section having a plurality of fastener engagement elements arranged along the length of the leg lower section for selective engagement of the leg lower section attachment fastener in one of the plurality of fastener engagement elements by the yoga user, the leg lower section having a leg lower section base attachment end; and a base having an arcuate friction layer for the base to make contact with a unipod prop support surface when in use by the yoga user, the arcuate friction layer in contact with a base unipod leg arcuate support surface on a base support structure having a base structural support system and a leg lower section joiner element for receiving the leg lower section base attachment end, the arcuate friction layer in contact with the base unipod leg arcuate support structure providing forward and backward positioning adjustment of the portable, adjustable height, resting position unipod yoga body support prop from a unipod support prop vertical position by the yoga user when the upper platform attachment fastener engages the upper platform unipod leg fastener engagement element, the leg lower section attachment fastener engages one of the plurality of fastener engagement elements and the leg lower section base attachment end engages the leg lower section joiner element.

2. The portable adjustable height, resting position unipod yoga body support prop of claim 1 wherein the upper platform leg fastener engagement element is centrally attached to a platform inner surface of the upper platform support structure opposing the upper platform body part support surface and the upper platform structural support system comprises:

an upper platform skirt surrounding an upper platform perimeter of the upper platform body part support surface; and a plurality of structural support upper platform support members radiating out from the upper platform leg fastener engagement element to an interior surface of the upper platform skirt, the plurality of structural support upper platform support members attached to the inner surface of the upper platform support structure opposing the upper platform body part support surface platform.

3. The portable adjustable height, resting position unipod yoga body support prop of claim 2 wherein the leg lower section joiner element is centrally attached to a base inner surface of the base support structure opposing the base unipod leg arcuate support surface and the base structural support system comprises:

a base skirt surrounding a base perimeter of the base unipod leg arcuate support surface; and a plurality of structural support base support members radiating out from the leg lower section joiner element to an interior surface of the base skirt, the plurality of structural support base support members attached to the base inner surface of the base support structure opposing the base unipod leg arcuate support surface.

4. The portable adjustable height, resting position unipod yoga body support prop of claim 3 where the leg upper section and the leg lower section are tubular with complementary cross sectional circular shapes configured for telescoping the length of the leg upper section into and out of the leg lower section.

5. The portable adjustable height, resting position unipod yoga body support prop of claim 4 wherein the upper platform attachment fastener comprises a spring-loaded upper platform snap button disposed within the first upper section end of the leg upper section with an upper platform button protruding through a first upper section end hole and the upper platform unipod leg fastener engagement element comprises an upper platform tubular section having a cross sectional geometric shape complementary for insertion of the first upper section end of the upper leg section into the platform tubular section with locking engagement of the upper platform button into an upper platform tubular section hole in the upper platform tubular section.

6. The portable adjustable height, resting position unipod yoga body support prop of claim 5 wherein the leg lower section attachment fastener comprises a spring-loaded leg lower section snap button disposed with the second upper section of the leg upper section with a leg lower section button protruding through a second upper section end hole and each of the plurality of fastener engagement elements comprises a lower leg section unipod height adjustment hole for locking engagement of the leg lower section button with the second upper section leg end telescoping into a leg lower section end opposing the leg lower section base attachment end.

7. The portable adjustable height, resting position unipod yoga body support prop of claim 5 wherein the leg lower section joiner element comprises a base tubular section having a cross sectional geometric shape complementary for insertion of the leg lower section base attachment end into the base tubular section.

8. The portable adjustable height, resting position unipod yoga body support prop of claim 5 further comprising an intermediate upper platform attachment fitting for seating in an upper platform tubular section without a hole, the upper platform tubular section hole provided in the intermediate upper platform attachment fitting.

9. The portable adjustable height, resting position unipod yoga body support prop of claim 7 wherein the leg lower section base attachment end is alternatively permanently fixed or removably fitted into the base tubular section.

10. The portable adjustable height, resting position unipod yoga body support prop of claim 2 wherein the upper platform leg fastener engagement element and the upper platform structural support system are formed from an injection molded thermoplastic material.

11. The portable adjustable height, resting position unipod yoga body support prop of claim 3 wherein the leg lower section joiner element and the base structural support system are formed from an injection molded thermoplastic material.

12. The portable adjustable height, resting position unipod yoga body support prop of claim 1 wherein the cushioning layer is alternatively permanently or removably attached to the upper platform body support surface with an adhesion material.

13. The portable adjustable height, resting position unipod yoga body support prop of claim 1 wherein the cushioning layer comprises a compressive material sprayed or otherwise applied in liquid form onto the upper platform body support surface.

14. The portable adjustable height, resting position unipod yoga body support prop of claim 1 wherein the leg upper section and leg lower section are formed from a tubular aluminum composition.

15. The portable adjustable height, resting position unipod yoga body support prop of claim 5 wherein the first upper section end hole and the second upper section end hole are spaced the same distance from their respective first and second ends of the leg upper section and aligned so that either end may be fitted into the upper platform leg fastener engagement element or the leg lower section.

16. The portable adjustable height, resting position unipod yoga body support prop of claim 1 further comprising a funnel guide ring fitted to the upper end of the leg lower section to assist in inserting the second upper section end of the leg upper section into the leg lower section.

17. The portable adjustable height, resting position unipod yoga body support prop of claim 1 wherein the upper platform and the base are rectangular in cross section shape with curved corners with the overall rectangular dimensions of the upper platform being approximately three times as large as the overall rectangular dimension of the base and the base has a maximum width of 4 inches.

18. A method of assembling the portable adjustable height, resting position unipod support prop of claim 1, the method comprising:

engaging the upper platform attachment fastener in the upper platform unipod leg fastener engagement element;

engaging the leg lower section base attachment end; and engaging the leg lower section attachment end fastener into one of the plurality of fastener engagement elements.

* * * * *